United States Patent [19]

Rauhut

[11] 3,940,604

[45] Feb. 24, 1976

[54] DEVICE FOR EMERGENCY LIGHTING

[75] Inventor: Michael McKay Rauhut, Bridgewater Township, Somerville County, N.J.

[73] Assignee: American Cyanamid Company, Stamford, Conn.

[22] Filed: Dec. 12, 1973

[21] Appl. No.: 423,949

[52] U.S. Cl. ..... 240/2.25; 240/37.1; 240/52 R

[51] Int. Cl.[2] ..... F21V 9/16

[58] Field of Search ..... 240/2.25, 52 R, 1 R, 6.4 R, 240/37.1

[56] References Cited

UNITED STATES PATENTS

| | | | |
|---|---|---|---|
| 2,750,490 | 6/1956 | McGoldrick | 240/37.1 |
| 3,539,794 | 11/1970 | Rauhut et al. | 240/2.25 |
| 3,591,796 | 7/1971 | Barker | 240/6.4 R |
| 3,638,258 | 2/1972 | Black | 240/2.25 |
| 3,829,678 | 8/1974 | Holcombe | 240/2.25 |

*Primary Examiner*—R. L. Moses

*Attorney, Agent, or Firm*—Charles J. Fickey; Gordon L. Hart

[57] ABSTRACT

An automatic device for providing chemiluminescent light from a chemical reaction of suitable compounds in the presence of a fluorescent compound, said device being an emergency source of illumination upon failure of public utility service.

9 Claims, 6 Drawing Figures

DEVICE FOR EMERGENCY LIGHTING

BACKGROUND OF THE INVENTION

1. Field of the Invention

This invention relates to systems and devices for automatically providing emergency light incorporating components which react chemically and provide excitation for a fluorescent compound. The invention more particularly relates to systems and devices in which the reactive components are maintained in a non-reactive condition until light is desired, the systems incorporating means to bring said components into a reactive condition and means to display the resultant light.

2. Description of the Prior Art

Illumination of means of egress from public buildings by means of artificial lighting is a requirement for public safety. The source of power is usually electrical and of assured reliability, such as the local public utility service. However, under certain circumstances it is desirable to have a source of light that is not electrically activated in the event of failure of the public utility service.

Light can be provided by chemical systems, wherein the luminosity is solely the result of a chemical reaction without requiring any electrical energy. Such light is known as chemiluminescent light.

Chemiluminescent light may be useful where there is no source of electricity. For example in emergencies wherein sources of electrical power have failed, a chemiluminescent system could provide light. Since the system requires no externally generated source of energy, devices can be made small and highly portable. Moreover, chemiluminescent light can be used where conventional illumination may not be desired. It is useful, for example, where electrical means could cause a fire hazard, such as in the presence of inflammable agents. Chemiluminescent light is also effective in the presence of water since there are no electrical connections to short out. Thus it may be seen that chemiluminescent light can have many useful applications for emergency lighting.

SUMMARY OF THE INVENTION

This invention comprises a combination of a chemical lighting system and a device for the automatic admixture and display of chemical light components upon failure of an electrical power source without the hazards of electrical lighting.

The invention can be especially useful in emergency situations where other forms of lighting would not be desirable. The chemical lighting system of this invention does not have the inherent dangers of ignitable lighting devices such as candles, gas, or oil lights.

DESCRIPTION OF THE PREFERRED EMBODIMENTS

The system consists essentially of two parts which comprise means for storing the components of the chemical lighting system and means for automatically activating and displaying the admixed components when a power failure occurs.

In this invention, the reactive components are displayed in an elongated flexible transparent or translucent plastic tube which is sealed on both ends, wherein the separate components may be brought into contact to produce the reaction which provides chemiluminescent light to be displayed in said plastic tube. When either of the reactants or both are fluid, they must be stored in separate tubes. A diluent and fluorescent compound can be in either of these two tubes. If the reactants are dry powdered solids, they may be kept together in one tube with a diluent in the other compartment. The components in each tube are brought together by bending the tubes to break the tubes and release the contents, and the combined components are displayed as a chemiluminescent light mixture. This chemical lighting device is disclosed and claimed in U.S. Pat. No. 3,576,987, which is hereby incorporated by reference.

The means for storing the components of the chemical lighting system can have several embodiments. One embodiment consists of two elongated thin-walled glass tubes, each sealed on both ends, contained within the transparent or translucent plastic tube. One glass tube is filled, wholly or in part, with one component of a two-component system and the other tube is filled, wholly or in part, with the second component. The outer plastic tube can contain a solvent, a third component of a three-component system, or it can be empty.

An alternative embodiment involves a single sealed glass tube in a plastic tube wherein one component of a two-component chemical light system is placed in the glass tube and wherein the second component is placed externally to the glass tube within the plastic tube.

In still another embodiment a sealed glass tube containing one component is sealed within a second glass tube containing a second component of the chemical lighting sysem. The outer glass tube is then sealed, placed within the flexible translucent plastic tube with a solvent, such as dibutyl phthalate, and the end of the plastic tube is heat-sealed.

The chemiluminescent system of this invention thus comprises the system as described accommodating the admixture of at least two chemiluminescent components and providing for the admixture in the plastic tube of at least two chemiluminescent components comprising either (a) a component containing a chemiluminescent compound and a second component containing a hydroperoxide compound, either or both components containing a diluent, or (b) a dry solid component containing both a solid chemiluminescent compound and a solid hydroperoxide compound and a second component comprising a solvent for said solid chemiluminescent compound and said solid hydroperoxide compound. Any other necessary ingredients for the production of chemiluminescent light, or for lifetime control, or for intensity improvement, or for storage stabilization must, of course, either be included in one of the two system components or included as additional components. In particular with the preferred oxalic-type chemiluminescent compounds of this invention, a fluorescent compound must be included in the system.

The preferred chemiluminescent system of this invention is more particularly disclosed and claimed in copending application Ser. No. 75,425, now abandoned, which is hereby incorporated by reference.

The preferred chemiluminescent system of this invention is a two-component system in which light is generated by the reaction of a hydroperoxide component with a chemiluminescent component which comprises, in combination, a chemiluminescent compound selected from the group consisting of (1) an oxalic-type anhydride of the type disclosed and claimed in commonly assigned U.S. Pat. No. 3,399,137, which is hereby incorporated by reference, (2) an oxalic-type amide of the type disclosed and claimed in U.S. Pat. No. 3,442,815, and in copending applications Ser. No. 211,807 and Ser. No. 211,810 which are hereby incorporated by reference, (3) an oxalic-type o-acylhydroxylamine of the type disclosed and claimed in copending application Ser. No. 886,395, which is hereby incorporated by reference, and (4) an oxalic-type ester disclosed and claimed in U.S. Pat. No. 3,597,362, which is hereby incorporated by reference, in the presence of a fluorescer compound and a solvent. Other suitable chemiluminescent compounds are 3-aminophthalhydrazide, 3,4,5-triphenylimidazole, 10,10′-dialkyl-9,9′-biacridinium salts and 9-chlorocarbonyl-10-methylacridinium chloride. The latter is disclosed and claimed in commonly assigned U.S. Pat. No. 3,352,791. All of the foregoing provide chemiluminescence when reacted with a hydroperoxide component in the presence of a base. Other chemiluminescent materials are described by K. D. Gunderman, Angew. Chemie. Int. Ed., 4, 455/1965.

The preferred chemiluminescent compound of this invention is an oxalic-type ester selected from the group consisting of (a) an ester of an oxalic-type acid and an alcohol characterized by acid ionization constant in water greater than $1.3 \times 10^{-10}$, and (b) a vinyl ester of an oxalic-type ester. Similarly, in a preferred embodiment thereof, the alcohol would be an aromatic alcohol substituted by a substituent characterized by a positive Hammett sigma value. The preferred species of oxalic-type esters include bis(substituted carboalkoxyphenyl)oxalate such as bis(2,4,5-trichlorocarbobutoxyphenyl)oxalate and bis(2,4,5-trichlorocarbopentoxyphenyl)-oxalate.

The peroxides employed in the components of this invention may be any hydroperoxide compound. Typical hydroperoxides include t-butylhydroperoxide, peroxybenzoic acid, and hydrogen peroxide. Hydrogen peroxide is the preferred hydroperoxide and may be employed as a solution of hydrogen peroxide in a solvent or as an anhydrous perhydrate compound which will generate hydrogen peroxide.

The peroxide concentration may range from about 15 molar down to about $10^{-5}$, preferably about 3 molar down to about $10^{-1}$ molar. The ester of this invention may be added as a solid or in admixture with a suitable solid peroxide reactant or in a suitable diluent, or alternatively dissolved directly in a solution containing the peroxide reactant.

Typical diluents, which additionally may be used in conjunction with the necessary diluent of this invention, are those which do not readily react with a peroxide such as hydrogen peroxide, and which do not react with an ester of oxalic acid.

Where a solvent is employed with the hydroperoxide-containing component of this invention said solvent can be any fluid which is unreactive toward the hydroperoxide and which accommodates a solubility of at least 0.01 M hydroperoxide. Typical solvents for the hydroperoxide component include water; alcohols, such as ethanol or octanol; ethers, such as diethyl ether, diamyl ether, tetrahydrofuran, dioxane, dibutyl diethylene glycol, perfluoropropyl ether, and 1,2-dimethoxyethane; and esters, such as ethyl acetate, ethyl benzoate, dimethyl phthalate, dioctylphthalate, propyl formate. Solvent combinations can, of course, be used such as concentrations of the above with aromatic anisole, tetralin, and polychlorobiphenyls, providing said solvent combination accommodates hydroperoxide solubility. However, when oxalic-type chemiluminescent materials are used, strong electron donor solvents such as dimethylformamide and dimethylsulfoxide should not, in general, be used as a major solvent component.

Where a solvent is employed with a component containing the chemiluminescent material any fluid can be used providing said fluid solubilizes at least 0.01 M concentration of the chemiluminescent material and is unreactive toward the chemiluminescent material. Typical solvents include ethers, esters, aromatic hydrocarbons, chlorinated aliphatic and aromatic hydrocarbons, such as those cited in the preceding paragraph. For oxalic-type chemiluminescent compounds, hydroxylic solvents such as water or alcohols and basic solvents such as pyridine should not be employed since such solvents used in general, react with and destroy oxalic-type chemiluminescent compounds. Solvent combinations may, of course, be used but such combinations when used with oxalic-type chemiluminescent compounds should not include strong electron donor solvents.

When a component comprising a solid chemiluminescent compound and a solid hydroperoxide is used, the solvent or solvent composition comprising the second component may vary broadly. Said solvent, however, should preferably dissolve at least 0.02 M concentrations of both, the hydroperoxide and the chemiluminescent compound, and for oxalic-type chemiluminescent compounds, strong electron donor solvents should be avoided as major solvent components.

The fluorescent compounds contemplated herein are numerous; and they may be defined broadly as those which do not readily react on contact with the peroxide employed in this invention, such as hydrogen peroxide, likewise, they do not readily react on contact with the chemiluminescent compound.

The color of the light emission will depend on the type of fluorescent compound and its spectral response. However, the visible color could be varied by using a colored outer tube.

The lifetime and the intensity of the chemiluminescent light obtained with the preferred oxalic-type chemiluminescent compounds of this invention can be regulated by the use of certain regulators such as:

1. By the addition of base to the chemiluminescent composition. Both the strength and the concentration of the base are critical for purposes of regulation.

2. By the variation of hydroperoxide. Both the type and the concentration of hydroperoxide are critical for the purposes of regulation.

3. By the addition of water.

4. By the addition of a catalyst which changes the rate of reaction of hydroperoxide with the oxalic-type ester. catalysts which accomplish that objective include those described in M. L. Bender, "Chem. Revs.'-'Revs.", Vol. 60, p 53 (1960). Also, catalysts which alter the rate of reaction or the rate of chemiluminescence include those accelerators disclosed and claimed in copending application Ser. No. 178,496 and U.S. Pat. No. 3,704,231, which are hereby incorporated by reference, and decelerators disclosed and claimed in U.S. Pat. No. 3,691,085, which is hereby incorporated by reference.

While acids are not in general accelerators for oxalic-type chemiluminescent reactions it should be noted specifically that acids are accelerators for the oxalic amide chemiluminescent compounds disclosed and claimed in copending application, Serial No. 844,657, which is hereby incorporated by reference.

More specifically, the advantages obtained by incorporation of a catalyst in conjunction with an ionized salt as disclosed and claimed in U.S. Pat. No. 3,704,231, which is hereby incorporated by reference, may also be obtained in this invention.

When oxalate-type chemiluminescent compounds are used in solution it may be desirable to include a stabilizing agent such as those disclosed and claimed in U.S. Pat. No. 3,718,599, which is hereby incorporated by reference.

DESCRIPTION OF THE DRAWINGS

The invention may be better understood by reference to the drawings in which.

The means for storing, automatically activating and displaying the admixed chemical components, as illustrated in FIGS. 1–6, is a self-contained unit connected to a source of electrical power 1 which induces sufficient electromagnetic force in a metallic substrate 2 to restrain and compress springs 3 which produce a bias force against a hinged plate 4.

Figure 1:
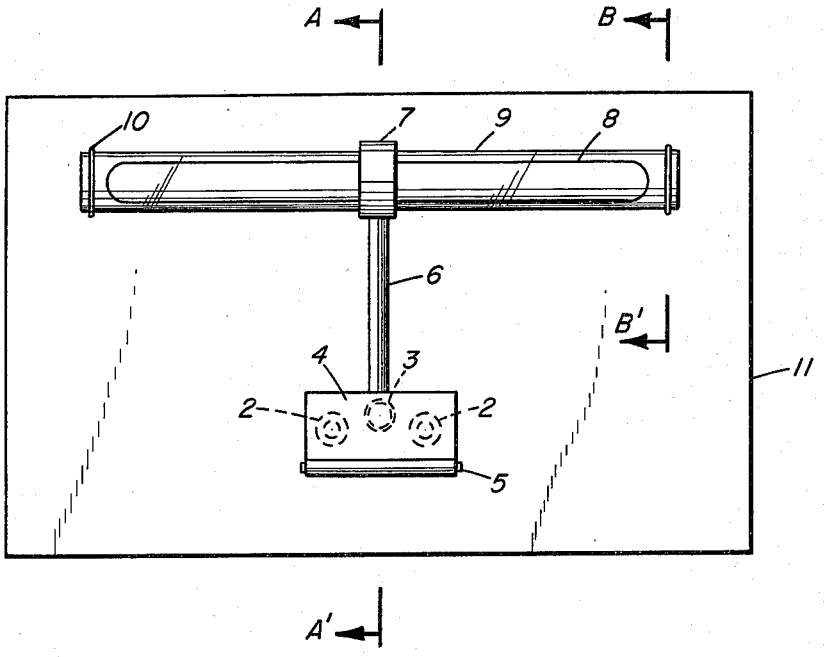
FIG. 1 is a frontal view of an embodiment of the system.
Figure 2:
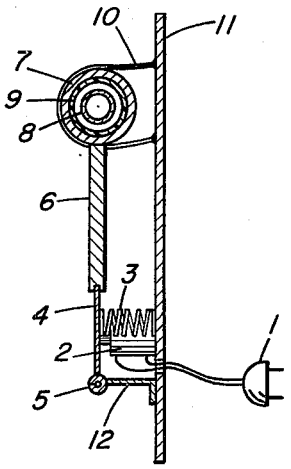
FIG. 2 is a cross-sectional view of the embodiment of FIG. 1, taken along the lines A—A′ of FIG. 1, before activation.

The electromagnets 2 are maintained by current supplied by the general power source 1 used for normal lighting, etc, at the location. Thus during normal power distribution the electromagnets are active and a lightstick is held in the before use position as shown in FIGS. 1 and 2.

The plastic outer tube 9 is held firmly at its center by a band clamp 7 attached to a rigid metal rod 6. In the before use condition, the rod and clamp hold the lightstick against a base plate 11. Also attached to the base plate are two loops 10 which loosely surround the ends of the lightstick. The rigid rod holding the lightstick is attached to a hinged iron or steel plate 4. Positioned between the base plate and the hinged plate attached to the rod is a strong compression spring 3, said spring being capable of forcing the lightstick free of the end loops on release of compression. The plate attached to the rod in the before use condition is held in place against the spring by one or two electromagnets attached to the base plate.

Figure 3:
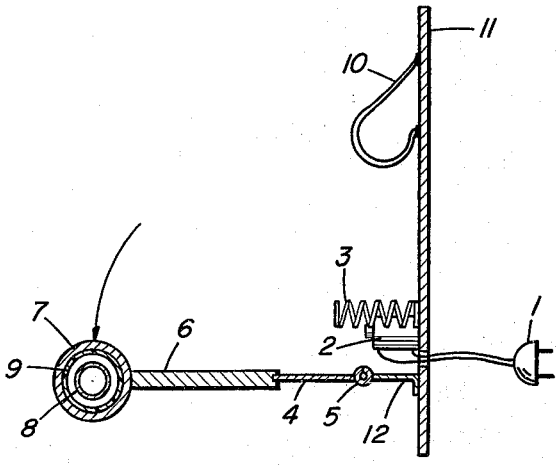
FIG. 3 is a cross-sectional view of the device of FIG. 2, after activation.
Figure 4:
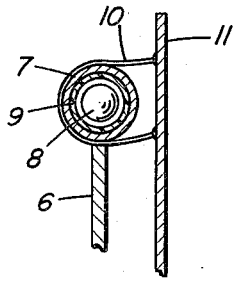
FIG. 4 is a cross-sectional view of the device of FIG. 1, taken along the lines B—B′ of FIG. 1, before activation.
Figure 5:
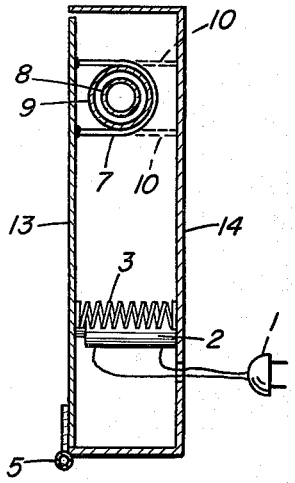
FIG. 5 is a cross-sectional view of an alternative device using a side of a metallic box instead of the rigid rod 6.
Figure 6:
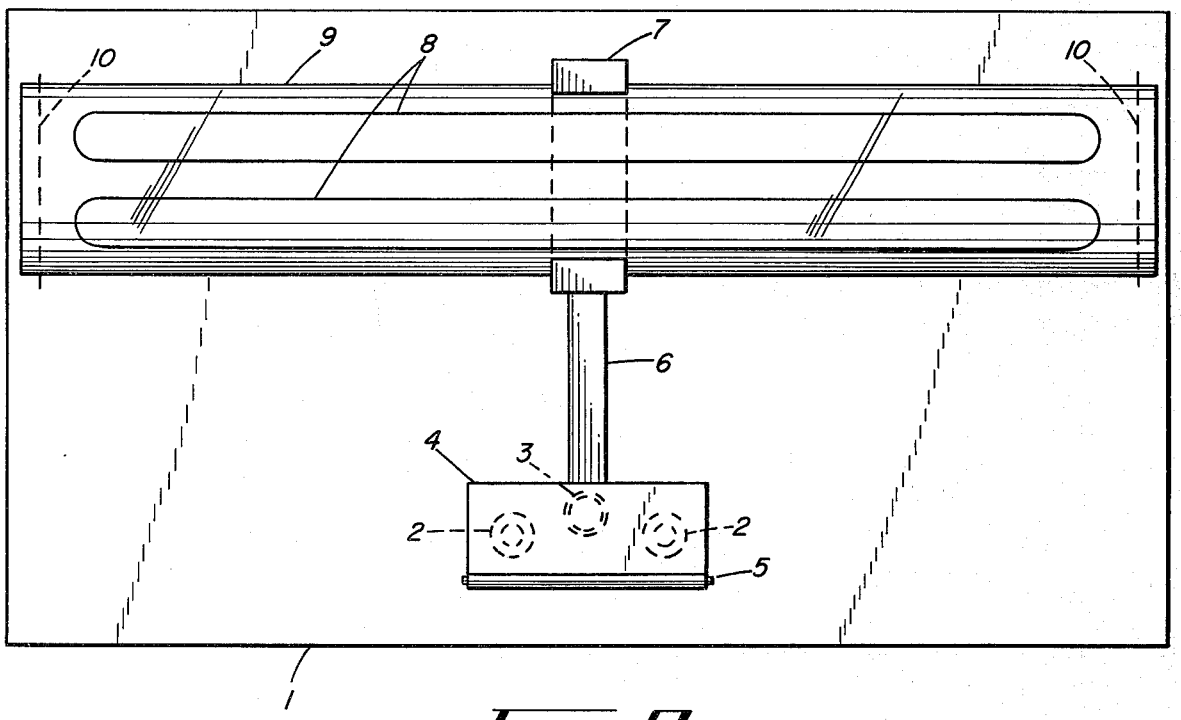
FIG. 6 is a frontal view of an alternative device using two glass tubes to contain the separate components.

In the event of a power failure the electromagnets lose magnetism, release the plate attached to the rod, and the compression springs force the plate-rod-clamp-lightstick unit away from the base plate. The lightstick in the course of this movement is restrained by the end loops. This restraining action causes the glass pods to be broken so that the chemical light components are mixed and light is emitted. Thus emergency light is provided automatically and displayed, as shown in FIG. 3, by the failure of distributed power.

Normally, the base plate, which may be part of a box, is attached to the vertical surface of a wall or door, or it may be attached to a ceiling. Thus the spring action is only required to pull the lightstick through the end loops to bend the lightstick and break the pods; gravity will then pull the lightstick further down to a desired angle from the base plate. A catch can be provided at the axle 5 to stop the downward movement at a particular angle, if desired.

While FIGS. 1–6 illustrate specific embodiments of the invention it will be understood that this is solely for illustration, and that various changes and modifications of the invention may be made without departing from the spirit of the disclosure or the scope of the appended claims. For example, "Exit" or other signs could also be illuminated by this invention. The inclusion of electrical lighting means within the specific embodiments of this invention is also contemplated.

EXAMPLE 1

A glass tube having an open end (0.2mm wall; 7.6 mm I.D.; 140 mm long; 6.36ml volume) is charged with 5.0 ml of a solution of 0.20 M bis(2,4,5-trichloro-6-carbopentoxyphenyl)oxalate and $6.0 \times 10^{-3}$ M 1,8-dichloro-9-10-bis(phenylethynyl)anthracene in dibutyl phthalate and the open end is heat-sealed in a flame.

A low density polyethylene tube (0.794 mm wall; 11.5 mm I.D.; 12.7 mm O.D.; 153 mm long) having an open end is charged with the above sealed glass tube and 5.0 ml of a solution of 0.75 M hydrogen peroxide (98%) and $3.125 \times 10^{-4}$ M sodium salicylate in a mixture of 80 volume percent dimethyl phthalate — 20 volume percent t-butyl alcohol and the open end is capped by a plug. (Alternatively the open end may be sealed by squeezing the tube together in a tube heat sealer. In this case the tube length overall should be about 178 mm long.)

The lightstick is inserted in the afore-described device which is connected to a source of electricity. The supply of electricity to the device is terminated and the plastic tube bends to slip out of the loose wires on the ends. The bending of the plastic tube causes theh rupture of the glass pod and admixture of the chemical components to generate light.

EXAMPLE 2

A glass tube identical to that described in Example 1 is charged with the same materials and sealed in the same manner as the glass tube described in Example 1.

A second glass tube of the same dimensions is charged with 5.0 ml of the hydrogen peroxide — sodium salicylate solution described in Example 1 and sealed.

Both tubes are placed in a 178 mm long polyethylene tube (0.794 mm wall; 19 mm O.D.) and the tube ends are heat-sealed by squeezing in a tube sealer.

Light is generated when the polyethylene tube is placed in the afore-described device and activated as described in Example 1.

EXAMPLE 3

A glass tube having the dimensions of the tube of Example 1 is charged with 5 ml of a solution of 0.20 M bis(2,4,5-trichloro-6-carbopentoxyphenyl)oxalate and $3.4 \times 10^{-3}$ M 9,10-bis-(phenylethynyl)anthracene in dibutyl phthalate and the open end is heat-sealed.

A second glass tube (0.2 mm wall; 6.5 mm I.D.; 140 mm long) is charged with 3 ml of a solution of 1.25 M hydrogen peroxide and $5.20 \times 10^{-4}$ M sodium salicylate in a mixture of 80 volume percent dimethyl phthalate — 20 volume percent t-butyl alcohol and the open end is heat-sealed.

The two tubes along with 2 ml of a solution of $3.4 \times 10^{-3}$ M bis(phenylethynyl)anthracene in dibutyl phthalate are placed in the polyethylene tube described in Example 2, and the ends of the polyethylene tube are heat-sealed. Light is generated by placing the polyethylene tube in the afore-described device and activating it as described in Example 1.

I claim:

1. A device for displaying emergency lighting comprising a base plate, an extension plate extending vertically from and affixed at one end to said base plate, pivot means attached to the other end of said extension plate, a metallic plate affixed at one end by said pivot means to said extension plate to allow said metallic plate to swing about said pivot means, an elongated rigid rod affixed at one end to the other end of said metallic plate opposite said pivot means, clamping means affixed to the other end of said elongated rigid rod, bias means affixed at one end to said base plate and positioned on said base plate to contact said metallic plate when said metallic plate is pivoted about said pivot means to aligned said rigid rod substantially parallel with said base plate, an electromagnetic force means affixed at one end to said base plate adjacent said bias means and disposed to contact said metallic plate when said metallic plate is pivoted about said pivot means to align said elongated rigid rod substantially parallel to said base plate, electrical power means connected to said electromagnetic force means to create an electromagnetic force so that when said metallic plate contacts said electromagnetic force means the bias means is compressed, a chemiluminescent light device comprising at least two elongated containers each container sealed on both ends and each containing a chemical component of a multicomponent chemiluminescent system, said containers comprising a translucent outer container and at least one rigid frangible inner container located within said outer container, said outer container held in the center by said clamping means, a pair of restraining means loosely encompassing each end of said outer container and affixed to said base plate so that when the electrical power fails the compressed bias means will press against said metallic plate bending said flexible outer container sufficiently to break the inner frangible container and cause the chemical components to become admixed after the ends of the outer container slip free of said restraining means to display the chemical lighting device in a position vertical to said base plate.

2. A device as in claim 1 wherein said chemical components are stored in at least two frangible inner tubular containers.

3. A device as in claim 1 wherein said translucent outer container is tubular means.

4. A device as in claim 1 wherein said metallic plate is made of iron.

5. A device as in claim 1 wherein said metallic plate is steel.

6. A device as in claim 3 wherein said translucent tubular outer container is plastic.

7. A device as in claim 2 wherein said frangible inner containers are glass.

8. A device as in claim 1 wherein said bias means is a compression spring.

9. A device as in claim 1 wherein said base plate comprises part of a shipping container for shipping said device.

* * * * *